United States Patent [19]

Lamb et al.

[11] Patent Number: 4,938,643

[45] Date of Patent: Jul. 3, 1990

[54] RAIL MOUNTED CRANE CARRIER

[75] Inventors: James H. Lamb, Franklin; Cliff Caneer, Jr., Cornersville, both of Tenn.

[73] Assignee: Span-Deck, Inc., Franklin, Tenn.

[21] Appl. No.: 224,792

[22] Filed: Jul. 27, 1988

[51] Int. Cl.[5] ..... B61D 15/00

[52] U.S. Cl. ..... 410/1; 104/44; 105/159; 414/339

[58] Field of Search ..... 410/1, 2, 3, 44; 105/157.1, 158.1, 158.2, 159, 199.1, 215.1, 218.2, 355, 455; 104/32.1, 44, 46; 414/339, 537; 180/53.4, 198, 9.44, 9.1

[56] References Cited

U.S. PATENT DOCUMENTS

| | | | |
|---|---|---|---|
| 2,728,304 | 12/1955 | Applegate | 105/215.1 X |
| 3,352,438 | 11/1967 | Davidson | 410/1 X |
| 3,610,169 | 10/1971 | Shannon | 410/1 X |
| 4,721,430 | 1/1988 | Littke | 105/215.1 X |

FOREIGN PATENT DOCUMENTS

| | | | |
|---|---|---|---|
| 2436038 | 5/1980 | France | 180/198 |

*Primary Examiner*—Margaret A. Focarino
*Assistant Examiner*—Dean J. Kramer
*Attorney, Agent, or Firm*—Kerkam, Stowell, Kondracki & Clarke

[57] ABSTRACT

A self-propelled rail transport vehicle for carrying a hydraulic crawler crane is provided. The transport vehicle is designed to normally travel along the rails of a track and allow crane operation either from the transport or from a ground off-loaded position. The crane may be delivered and loaded on and off the transport at any convenient ground rail location, and when taken off the transport, may be used to lift the transport from the tracks, so as to allow trains to pass unobstructed. The crane may then be used to lift the transport back on the track after which the crane may be loaded onto the transport. Once the job at a site is complete, the carrier and crane may be returned to its original location by rail or by truck. A latching mechanism is located in the center of the carrier deck of the transport. The latching mechanism is adapted to engage with a retractable pin mounted to the underside of the car body of the crane. The crane is loaded by driving it onto the carrier with its tracks perpendicular to the longitudinal axis of the carrier. As the crane is driven onto the carrier, the hydraulic pin is extended and moves into its latched position to prevent forward or backward movement of the crane vehicle on the carrier, while allowing counter-rotation of the crane about the axis of the pin. The crane may thus be positioned along the longitudinal axis of the carrier without danger of falling from the platform.

13 Claims, 13 Drawing Sheets

RAIL MOUNTED CRANE CARRIER

FIELD OF THE INVENTION

The invention relates to a rail mounted crane carrier or transporter and more particularly to a self-propelled hydraulically driven crane carrier or rail transporter, having an automatic latching mechanism which allows the crane to be counter-rotated on the transporter and transported with its tracks parallel to the longitudinal axis of the carrier.

BACKGROUND OF THE INVENTION

It is common for maintenance vehicles to travel along a railroad track while performing various types of rail maintenance operations. The use of such machines must be planned around the schedules of trains using the rails. When a side rail or loading rail is not readily available, provision must be made for removing the transporter from the track to permit the regular scheduled train to pass.

In addition to regular rail maintenance, there is also a need for heavy duty vehicles such as hydraulic crawler cranes to be used at a rail site. For example, in the case of a train wreck or derailment, a crane may be necessary to move heavy rail cars and assist in clearing the tracks. Frequently, it is necessary to perform such work at locations where roadway access is limited or even non-existent. Any attempt to rely on roadway travel in such situations could delay the arrival of necessary equipment. In such emergency situations, time is generally of the essence.

Vehicles and machines presently used for this type of operation can in general be removed from the main track only at specially prepared landings, or at existing track sidings. Since special landings and sidings are often quite far apart, considerable working time is lost while proceeding to, waiting at, and returning from the place at which the maintenance machine can be removed from the track. Further, since trains frequently fail to rigidly adhere to schedules, removal of the vehicles in anticipation of the arrival of the train can often lead to considerable delays and lost time.

Transport of heavy duty crawler cranes on rail carriers creates unique problems. For example, a standard carrier is normally about 8 feet wide. This width limitation is occasioned by conventional rail spacing which in turn frequently determines available side clearance along the rail bed. The longitudinal carrier deck dimension can readily accommodate the tracks of a heavy duty crawler crane which generally extends about 18 feet, but the limited 8 foot width does not allow for maneuvering a crane along the length of the carrier. Thus to load and carry such a crane onto a carrier, either a special load site or platform is required which would permit direct end loading, that is driving of the crane directly onto the platform from either end, or the crane must be loaded and carried perpendicular (broadside) to the longitudinal access. The former solution is expensive and not practical because of the location of the carrier wheels at opposite ends of the carrier. The latter solution is not practical because the crane would extend considerably beyond each side of the carrier and would not clear many obstructions along the track.

SUMMARY OF THE INVENTION

The present invention avoids the problems encountered by prior art transporters and provides a self-propelled rail transport vehicle for carrying a hydraulic crawler crane. The transport is designed to normally travel along the rails of the track and allow crane operation either from the transport or from a ground off-loaded position. The crane may be delivered on and off the transport at any convenient location and when off the transport may be used to lift the transport from the tracks, so as to allow trains to pass unobstructed. The crane may then be used to lift the transport back onto the track after which the crane may be loaded, once the job is complete, onto the transport and returned to its original location.

In accordance with a preferred embodiment of the invention, a latching mechanism is located in the center of the carrier deck of the transport. The latching mechanism is adapted to engage with a retractable pin mounted to the underside of the car body of the crane. The crane is loaded by driving it onto the carrier with its tracks perpendicular to the longitudinal axis of the carrier. Ramps may be provided on either side of the carrier and caused to pivot out and down to allow loading or off-loading of the crane vehicle. Once in position on the carrier, the hydraulic pin is actuated to its latched position to prevent forward or backward movement of the crane vehicle on the carrier, but allows rotation of the crane about the axis of the pin. The crane may thus be positioned along the longitudinal axis of the carrier without danger of falling from the platform In accordance with another object of the invention, the carrier is powered using the existing hydrostatic hydraulic system of the crane. The carrier drive motors at opposite ends of the carrier are provided with quick disconnect fittings for connecting to the hydraulic power system of the crane.

In accordance with a further object of the invention, the carrier is equipped with pivotable axle assemblies and doubleacting hydraulic jacks, located to permit jacking directly upon the railhead. The jacks are of sufficient capacity to lift the gross vehicle weight. With the carrier and crane thereon supported by the jacks, the axle assemblies at either end of the carrier may be unlatched and pivoted upwardly. The carrier can then be lowered to rest on the heads of the cross ties and ramps on either side of the carrier pivoted out to allow loading or off-loading of the crane and truck transport of the carrier.

Another object of the present invention is to provide a rail mounted carrier or transport vehicle which can be rapidly and easily moved from the track at substantially any point to permit a train to pass and then be returned to the track for normal operation.

Another object of the present invention is to provide a rail mounted carrier which enables a heavy duty crane to be transported along the track with the crane carried with its longitudinal axis parallel to the longitudinal axis of the carrier.

A further object of the invention is to provide a cooperating latch and pin assembly between a rail mounted carrier and crawl track vehicle which enables the vehicle to be counter-rotated about the axis of the pin for positioning the tracked vehicle along the longitudinal axis of the carrier.

BRIEF DESCRIPTION OF THE DRAWINGS

These and other objects and advantages of the invention will become apparent to those skilled in the art from the following detailed description taken in connection with the accompanying drawings wherein.

Figure 1:
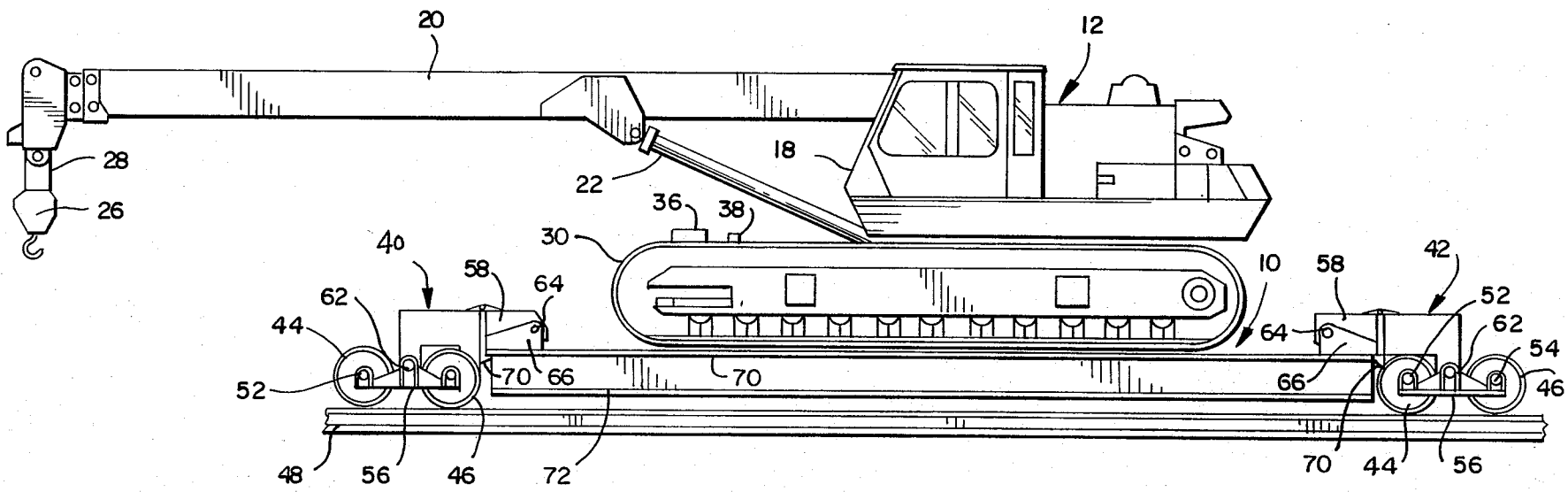
FIG. 1 is a side elevational view of the carrier of the present invention with a crane mounted thereon.

The foregoing drawings, when taken in connection with the following description and claims will provide a full and complete description of the invention and of the manner and process of making and using it; however, as a further aid in understanding the details of construction, the following drawings and publications are filed with the application to be retained as part of the record and are hereby incorporated by reference:

FIG. 15 —Pivot Suspension Ass'y 5012 Rail Car, CRO 500-200-000, Sheet 1 of 2;

FIG. 16 —Suspension Arm Ass'y —5012 Rail Car - CRO 510-210-000, Sheet 2 of 2;

FIG. 17 —Car Body Ass'y, CR 5012-102, Sheet 1 of 2;

FIG. 18 —Car Body Ass'y, CR 5012-102, Sheet 2 of 2;

FIG. 19 —Beam Ass'y, Car Body CR 5012-102, Sheet 1 of 1;

FIG. 20 —Tube Ass'y, Car Body, CR 5012-102

MANTIS crawler crane advertising flyer and specification sheet for Mantis Model 5012 25 ton hydraulic crawler crane.

It should be noted that the rail transporters and crawler cranes are well known in the art and by themselves form no part of the present invention. It will be recognized, however, that the adaptation of the car body of the crane to include a pin assembly which cooperatively engages a latch assembly mounted to a rail transporter or carrier and permits the crane to be loaded perpendicular to the longitudinal axis of the carrier and counter rotated about the axis of the pin to position the crane along the longitudinal axis of the carrier presents a new and useful combination not heretofore available to the rail industry.

DESCRIPTION OF THE PREFERRED EMBODIMENTS

Before proceeding to the drawings, a brief summary of the characteristics of the crane and carrier will be given to provide a fuller understanding and appreciation of the invention and the advantages thereof.

Generally the carrier deck is approximately 8 feet wide and 21 feet long providing a fully clear floor area with 2 inch thick hardwood, preferably oak deck. Other materials can be used taking into consideration the weight to be carried. The maximum load capacity is 87,000 pounds Gross Vehicle Weight (GVW) is approximately 112,000 pounds. The overall length on the rail of the carrier and wheel assemblies is approximately 40 feet. The rail wheel assemblies are pivotable approximately 180 degrees and when in the stored pivotable position, the overall length is reduced to 26–28 feet to facilitate transporting the unit by over the road truck. The carrier deck height in crane loading/unloading position is 18 inches above base of rail. The carrier deck height in the working position is 22 inches above rail head with 4 inch minimum clearance between rail head and carrier structure.

The suspension unit has a minimum 60,000 pound capacity walking beam type tandem axle sets at each end of carrier, with approximately 1-½ inch spring travel before loading 'solid suspension after loading. One axle set allows rotation about the longitudinal axis of the carrier to compensate for a minimum of 2 inch variation in rail height on 59.500 inch gauge rails. The axle set on the opposite end of the carrier is fixed against such rotation. One axle of each axle set is a locked differential (ring gear and pinion) heavy duty off road carrier design driven by a hydraulic motor. The second axle of each set is a non-powered straight tubular design with hub assemblies identical to the driven axle set. The wheel units include non-insulated 24 inch cast steel wheels designed and with treads hardened to optimize wheel life under specified loading conditions. Conventional nondrive wheels and wheel braking is provided. The brake shoe is applied to the wheel tread, spring applied and hydraulically released to provide failsafe operation. Brake shoes are attached to a cast mounting head with drop-in keys. Shoes are 8 inch, composition V237—51. Brake system operating pressure-1500 PSI, with capability of modulating brake pressure from the crane cab on board the carrier. Connection to the hydraulic system of the equipment on board the carrier is by hoses equipped with quick disconnect fittings available at either end of the carrier.

The carrier drive system unit is powered using the existing hydrostatic hydraulic system of the equipment (crane) on board the carrier and provides dynamic braking. Travel speed is approximately 15 mph on level track and the unit is to be capable of traversing a 6% adverse grade. The hydraulic system supply parameters are 0–120GPM up to 1950 PSI, with flow decreasing linearly to 0 GPM at 3750 PSI. The carrier drive motors are piped in parallel on the carrier with quick disconnect equipped hoses available at either end of carrier for connecting to the hydraulic system of the equipment providing the power source.

The carrier is provided with four (4) double-acting hydraulic jacks, located to permit jacking directly upon the rail head. The jacks are of sufficient capacity to lift the gross vehicle weight at an operating pressure of 2000 psi. With the carrier and its payload supported by the jacks, the axle assemblies at either end of the carrier may be pivoted and unlatched to allow the carrier to be lowered to rest on the heads of the cross ties. Ramps on either side of the carrier pivot out and down to allow off loading of the payload.

To load the carrier, the crane is driven on the carrier with its tracks perpendicular to the longitudinal axis of the carrier. Located in the center of the carrier deck is a spring biased latching mechanism which engages a hydraulically operated retractable pin mounted to the underside of the equipment car body. With pin engaged, the crane can be counter-rotated on carrier safely while loading and unloading.

Referring now to the drawings, and in particular FIGS. 1–5 these show the rail transport or carrier vehicle 10 and its payload 12, which for purposes of description, and not by way of limitation, is illustrated as a 25 ton hydraulic crawler crane of the Mantis 5012 type manufactured by Span Deck, Inc., of Franklin, Tennessee. Crane 12, with the exception of the pin assembly 14 mounted to the under carriage 16 of cab 18, is conventional. In addition to cab 18, crane 12 includes boom 20 supported by jib 22. A standard hydraulic winch 24 is used to raise and lower the sleeve hook block 26 through cable 28.

As is well known in the art, independent hydrostatic drives to tracks 30 and 32 are provided through right angle planetary reducers and drive sprockets. The hydraulic system is connected to retractable hose reel units 34, 36 with quick disconnect fittings for connecting the hydraulic system of the crane to the hydraulic unit fittings of the carrier provided at any convenient location for operating the wheel units, the brake system, and the hydraulic jacks. One or more quick disconnect fittings 38 are also conveniently located on the crane 12 to allow use of accessary hydraulic tools or jacks which might be used by a work force or for connection to other hydraulic operated elements on the carrier.

Carrier 10 includes a front and rear walking beam type tandem axle set 40, 42, respectively, which provide a pivot suspension having a minimum 60,000 pound capacity. The tandem axle sets are conventional and shown in greater detail in drawings CRO 500-200-000, sheet 1, and CRO 500-200-000 and sheet 2. Each axle set includes two pairs of wheels 44, 46 adapted to ride on rails 48, 50, respectively. Axles 52 support wheels 44 and axles 54 which support wheels 46 are suspended by beam bar 56 and a pivotable support arm 58. Each arm 58 includes a lower rod 60 about which a "U" bolt 62 is connected for supporting the beam bar 56. The other end of arm 58 is pivoted about pin 64 mounted to a plate 66 on carrier 10. This arrangement allows the entire rail wheel assemblies to be rotated about the axis of pin 64 almost 180 degrees to a stored position. This enables the carrier to be conveniently moved off the tracks and shipped to other locations by over the road truck. In the operative position, the suspension units or tandem axle sets of the carrier are latched in position. To this end, a latch 66 is pivotally supported on rod 68 disposed transversely of and supported at the top of beam bar 56 approximately midway thereof. Latch 66 includes a hook and 70 adapted to engage the undersurface of beam 72. While only a single axle set has been described, it should be apparent that the construction of each is substantially identical. The inward axle set is of the non-powered type, straight tubular design. The outermost axle set includes drive motor 74 provided with fitting 76 for connection to the hydraulic system of the payload 12.

Figure 13:
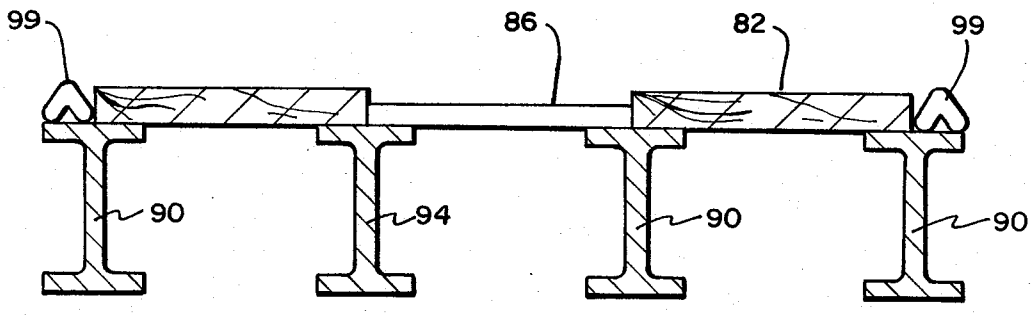
FIG. 13 is a side elevational view of the frame deck of the platform of the carrier according to the invention.
Figure 14A:
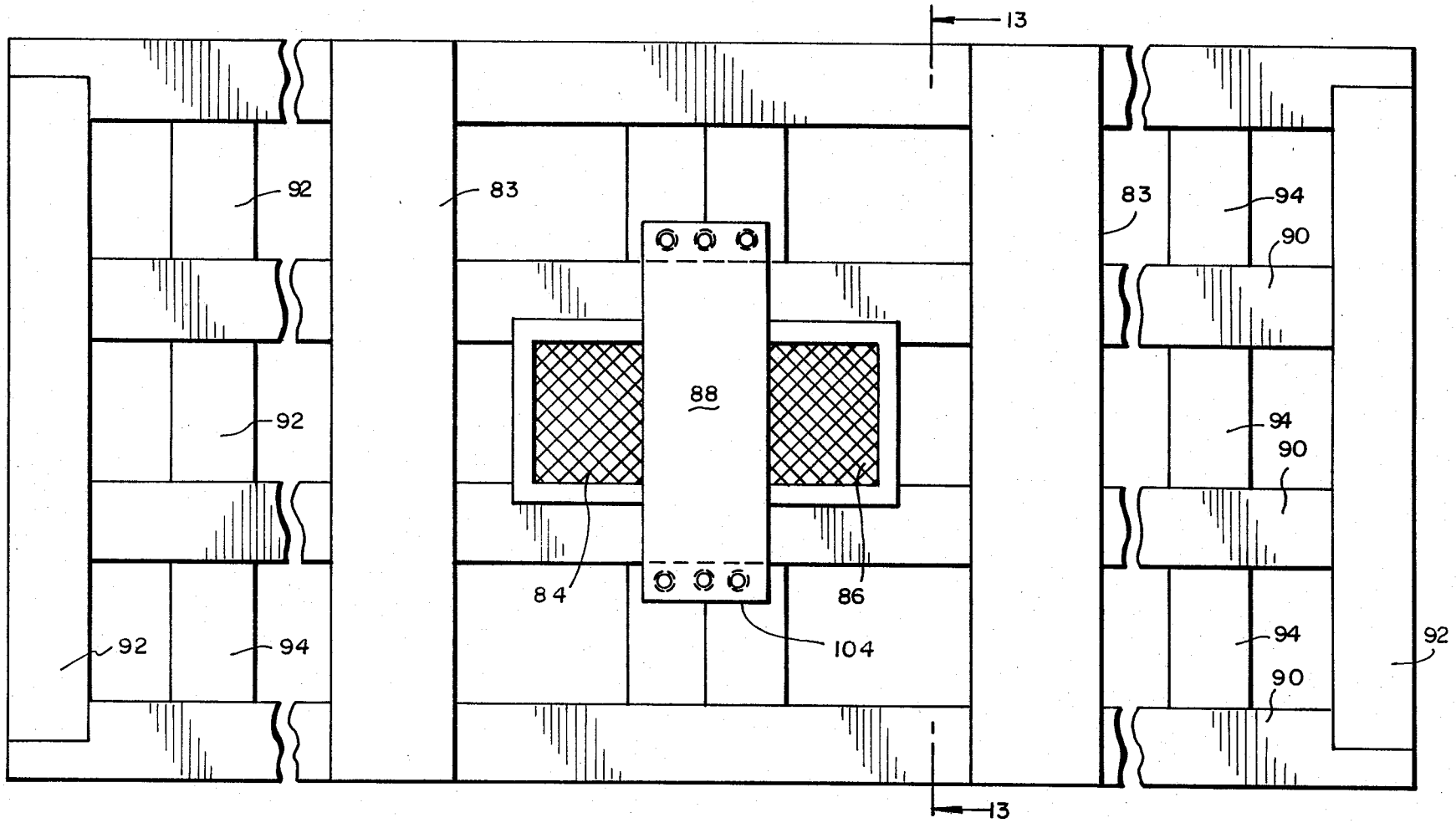
FIG. 14A is a plan view of the frame deck shown in FIG. 13.
Figure 14B:
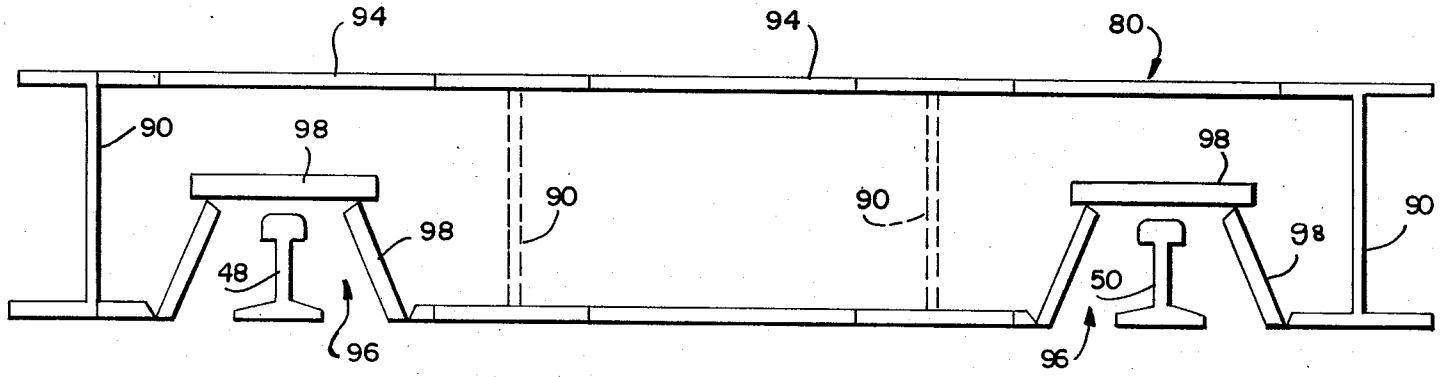
FIG. 14B is aside elevational view of a cross member.

Crane or payload 12 is adapted to be carried on platform 80 shown more clearly in FIGS. 13, 14, and 15. Referring to these figures, it will be seen that platform 80 comprises a centrally disposed out deck section 82, supporting a pair of central access grates 84, 86, between which is mounted the latch assembly 88 of the carrier adapted to cooperate with assembly 14 located in the under pin carriage 16 of cab 18. Platform 80 is supported across the framework of the carrier which comprises four (4) longitudinally extending and spaced "I" beams 90 and cross beam members 92 at opposite ends and internal cross plates on pieces 94. The lower portion of cross plates 94 includes two raised channels 96 to provide clearance for rails 48 and 50 as best shown in FIG. 15. The edges of plate 94 have welded thereto a series of wear plates 98. Wear plates 99 are also provided along the longitudinal edge of the decking. While decking 82 is shown as forming a central portion of the platform and fabricated from planking, it should be readily apparent that the platform may be continuous from one end to the other formed by welding or fastening a series of plates 83 in any suitable manner.

Figure 2:
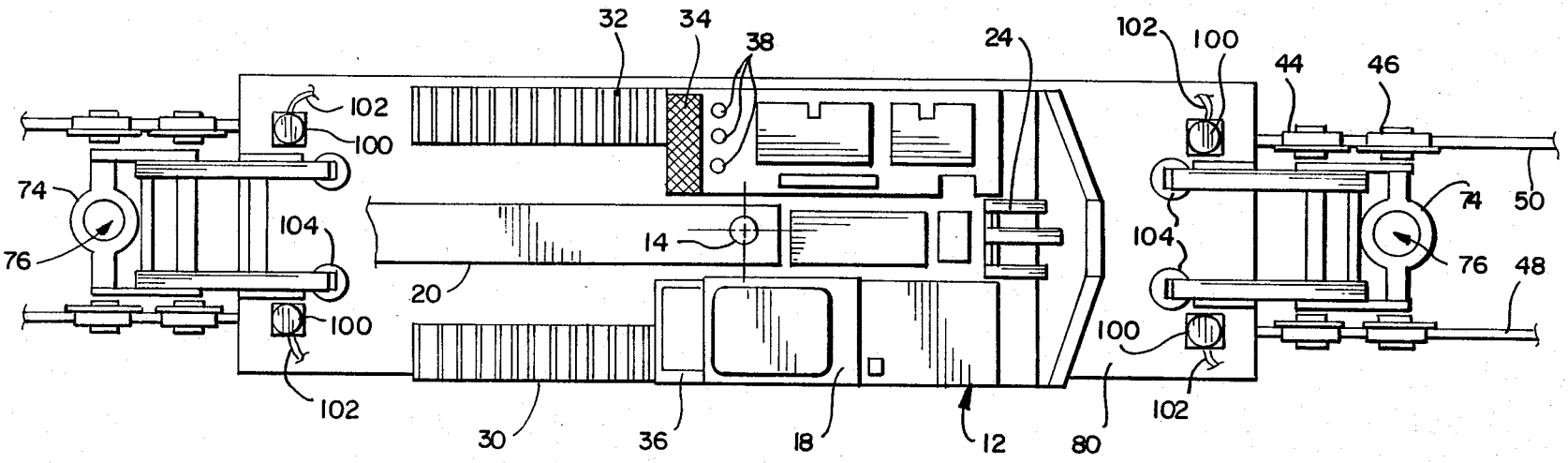
FIG. 2 is a plan view of the carrier and crane shown in FIG. 1.
Figure 3:
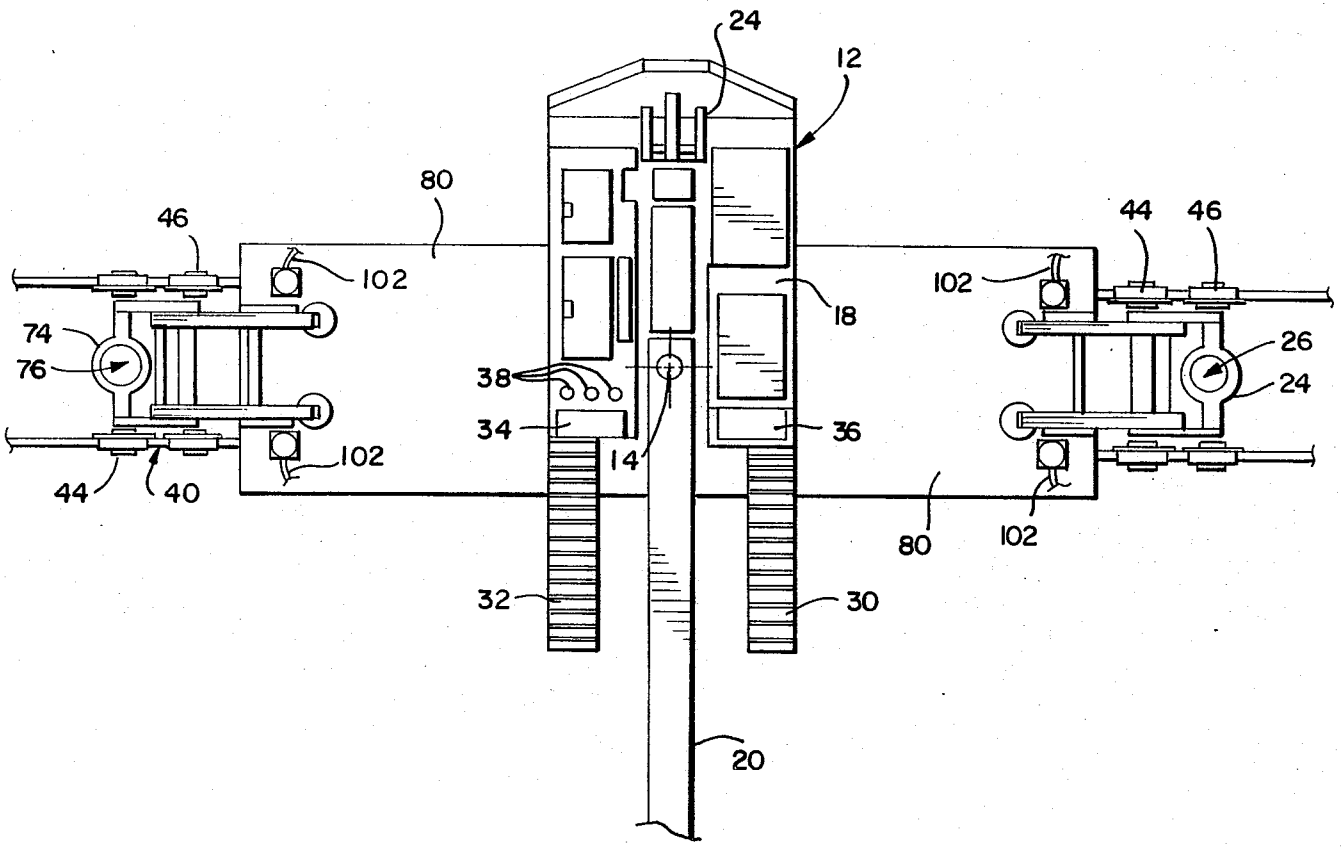
FIG. 3 is a plan view of a carrier of FIG. 1 with the crane rotated 90 degrees to its loading or unloading position.
Figure 5:
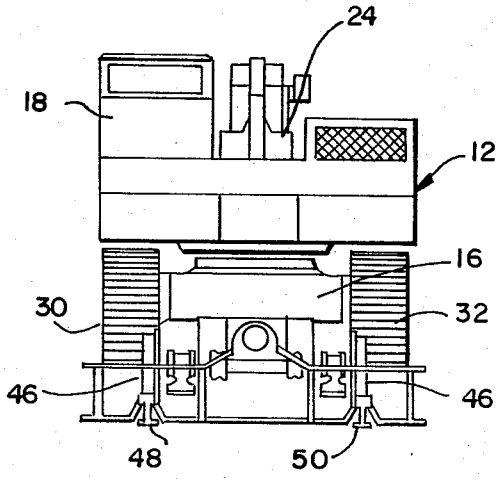
FIG. 5 is a rear end view of the carrier and crane of FIG. 1 with the carrier lowered to its down position resting on the heads of the cross ties.
Figure 4:
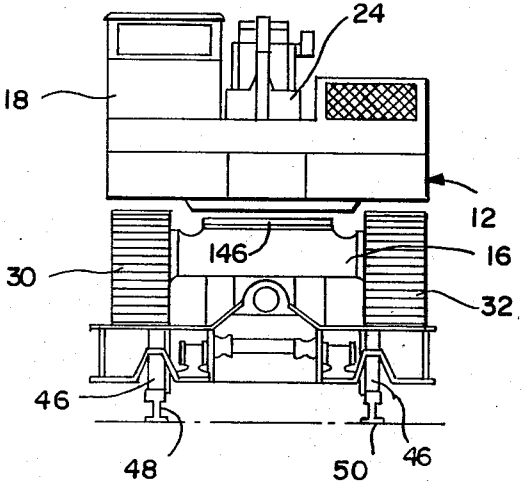
FIG. 4 is a rear elevational view of the carrier and crane of FIG. 1 with the carrier shown in the travel position.

Referring now to FIG. 3, it will be seen that carrier 10 is provided with four double acting hydraulic jacks 100. Each jack is mounted at approximately a corner of the carrier 10 and slightly inward thereof so as to be disposed directly over the head of a rail. Each jack 100 is connected by suitable tubing or hosing 102 to the hydraulic system of the vehicle 12 carried on the carrier. When energized, the jacks press against the rail to lift the entire gross weight of the carrier to permit release of the pivot latches 66 for the wheel axle assemblies. As shown in FIGS. 1 and 2, suitable clearance openings 104 are provided in platform 80 to ensure no obstruction when the wheel assemblies are swung upward to the stored position.

Figure 11:
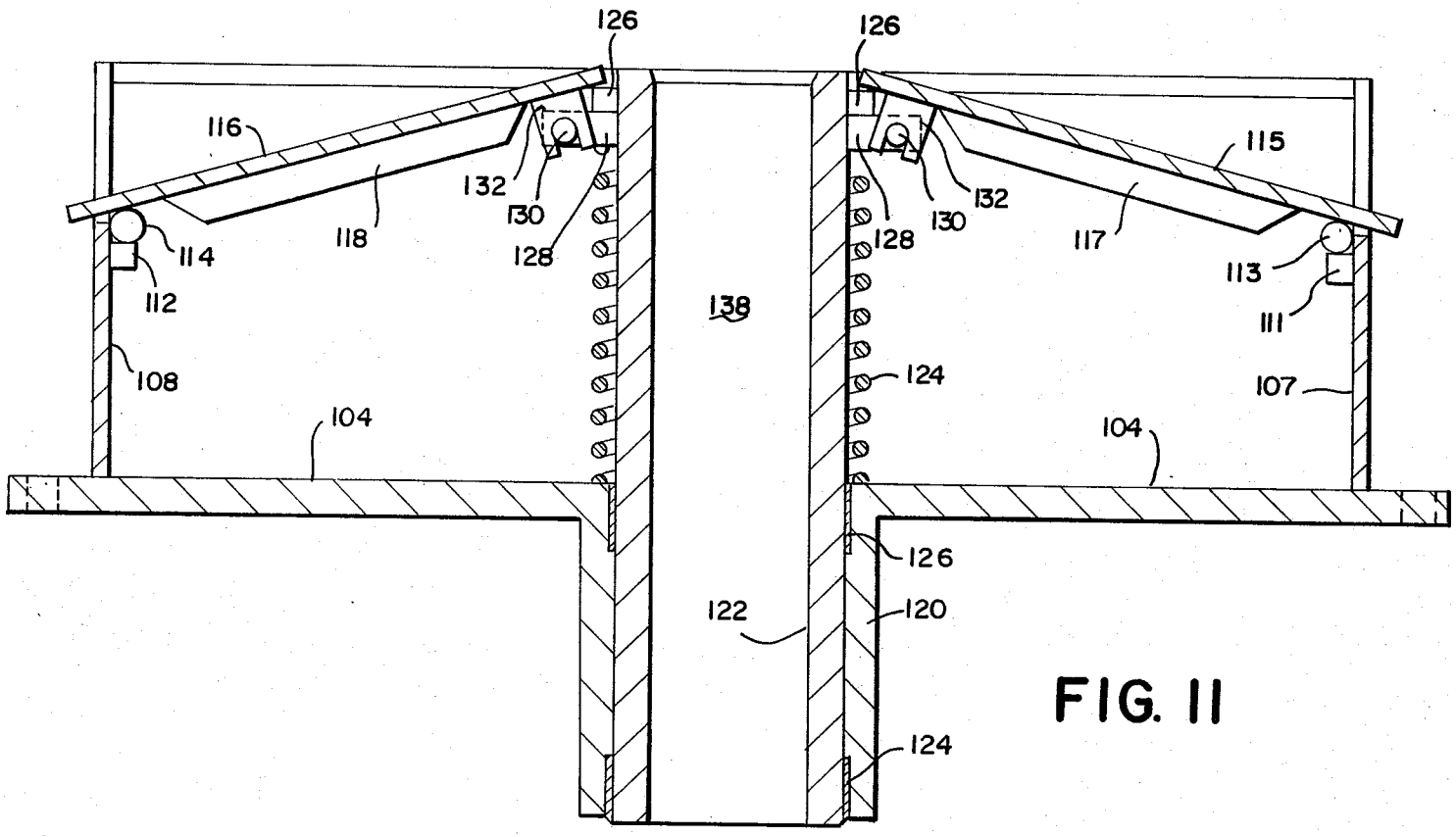
FIG. 11 is a cross-sectional side elevational view, partially fragmentary, of the latch assembly on the rail carrier in accordance with the present invention.
Figure 12:
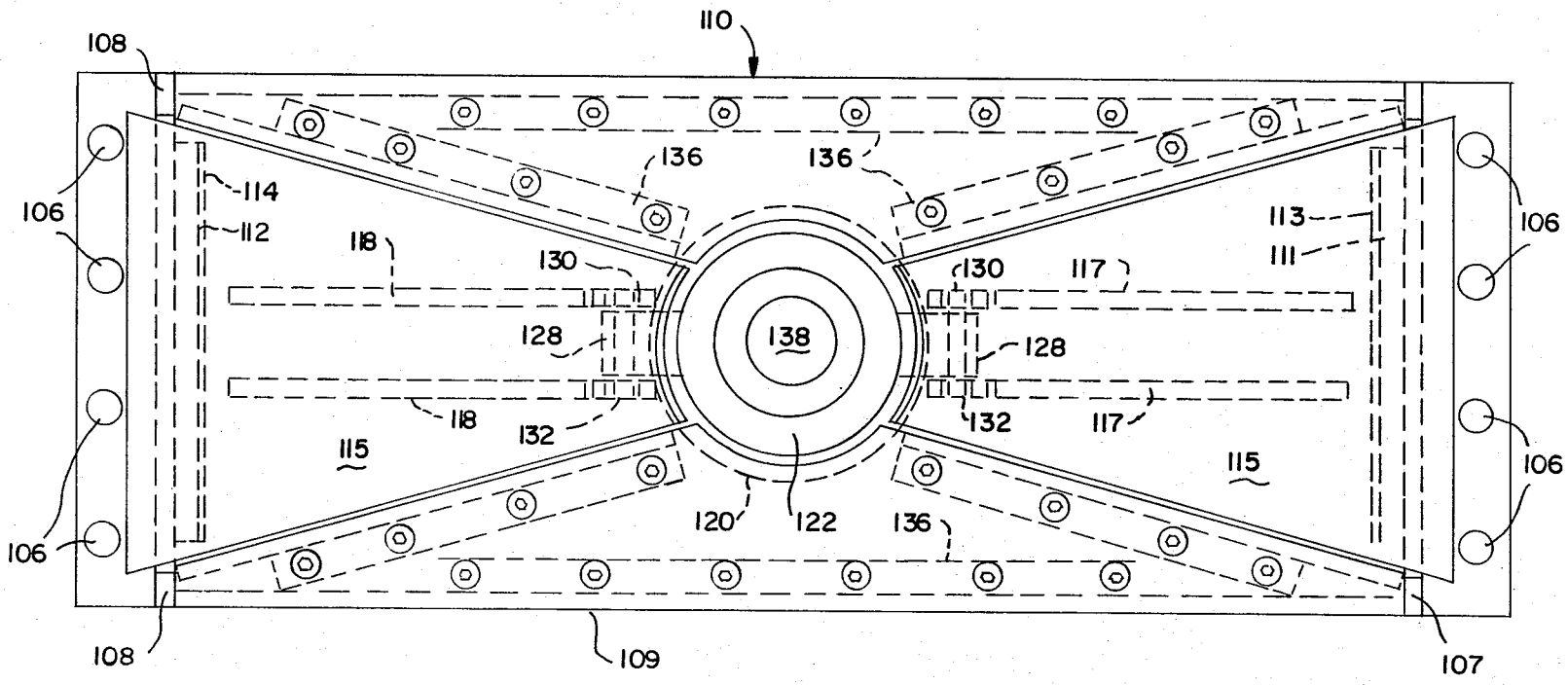
FIG. 12 is a plan view of the latch assembly of FIG. 10.

Referring now to FIGS. 11 and 12, there is illustrated the latch assembly 88 of the present invention which includes a baseplate 104 fastened to deck 82 by suitable fastening members 106. Extending upward from plate 104 are end plates 107, 108 and side plates 109, 110. End plates 107 and 108 have welded thereto, respectively, near their upper end a square roll bar support 111, 112 each of which in turn supports an associated roll bar 113, 114. Plates 107 and 108 are slotted adjacent their top end to accommodate a slide plate, 115, 116, respectively. Depending from slide plate 115 are a pair of stiffener gussets 117. A like pair of stiffener gussets 118 depend from slide plate 116. Centrally disposed of base plate 104 and depending therefrom is an outer cylindrical sleeve 120 which receives therein an inner cylindrical sleeve 122 adapted to slide in sleeve 120 to receive and latch the pin assembly of the vehicle 12. To this end, a pair of ring bushings 124, 126 are disposed in lower and upper internal grooves provided in the outer sleeve 120. Sleeve 122 is biased upwardly by compression spring 125 which is seated at its lower end against base plates 104 and at its upper end against stop ring 127 welded to the outer sleeve. Also disposed at the upper end of sleeve 122 are a pair of pivot lugs 128 to which is welded a transverse pin 130 for pivotally supporting one end of plates 115 and 116. To this end, each plate has depending therefrom a pair of pivot brackets 132, each having a "U" slot to cradle pin 130. The latch assembly 82 includes a plurality of stiffeners and supports 134, as well as a plurality of top bars 136 shown in phantom in FIG. 12 for fastening the cover and various plates.

In operation, the vehicle 12 is driven up onto the platform as previously described with the pin assembly engaging one of slide plates 115. Plate 115 pivots or rolls at one end about bar 113 or bar 114, depending on which side the crane is loaded from and at the other end about pin 113. The weight of the vehicle 12 overcomes the bias of spring 124 causing sleeve 122 to be pushed downward, the total vertical movement being about 3 inches. When the pin assembly is positioned over the latch assembly, the pin is latched into the inner sleeve opening 138. Opening 138 is beveled at the top to allow for slight misalignment and guiding of the pin in place.

Figure 6A:
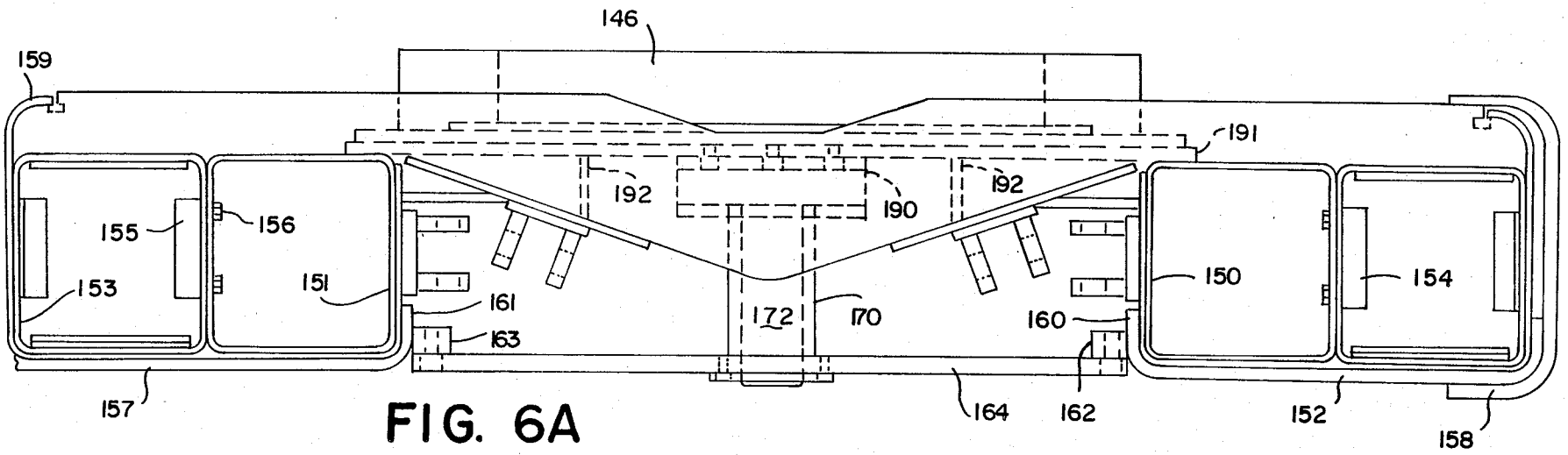
FIG. 6A is a side elevational view of the pin assembly mounted beneath the car body of the crane shown in FIG. 1
Figure 6B:
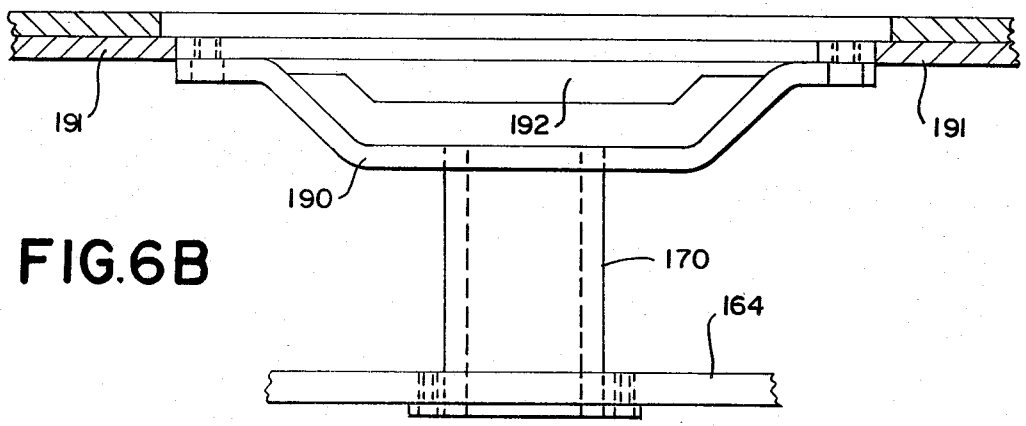
FIG. 6B is a fragmentary, partial cross section of a side elevation of the pin assembly of FIG. 6A.
Figure 7:
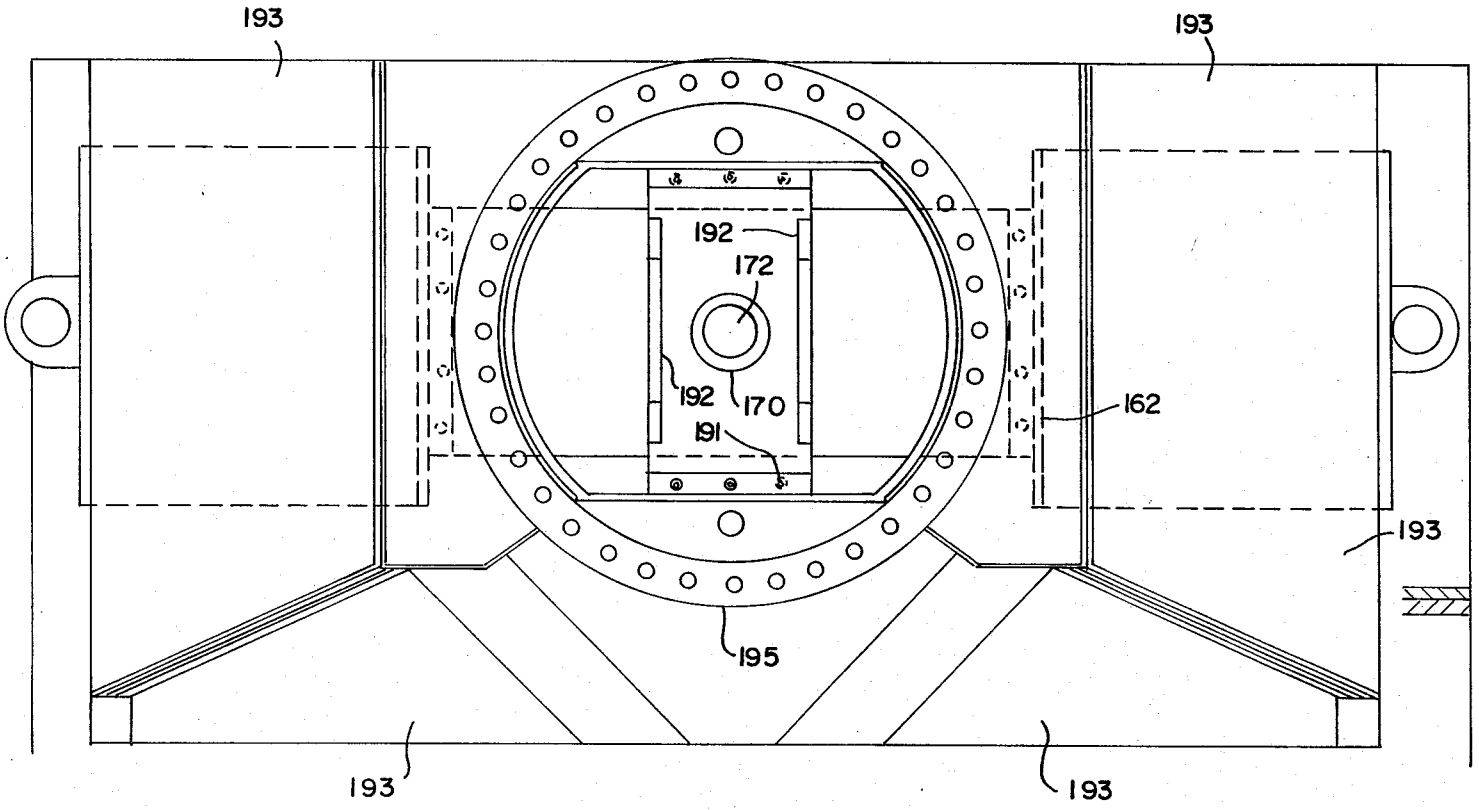
FIG. 7 is a plan view of the pin assembly shown in FIG. 6A.

Referring now to FIGS. 6–11, there is illustrated the details of the pin assembly 14 of the present invention which is perhaps most completely illustrated in FIGS. 6A and 6B. As shown in FIG. 6A, the pin assembly is mounted between the inner box frames 150, 151 of the crane 12 and below the outer slew ring 146. Frames 150, 151 of crane 12 extend between the tracks 30 and 33 of the crane. A second set of outer box frames 152 and 153 connected by suitable tap bars 154 and 155 and fasteners 156 are included. Box frames 150–153 are reinforced by wrap around frame members 157, 158 and 159. Bars 157 have welded to their inside surfaces 160 and 161 a lower tap bar 162 and 163, respectively to which is mounted a belly or base plate 164 which forms the bottom of the pin assembly 14.

Figure 8:
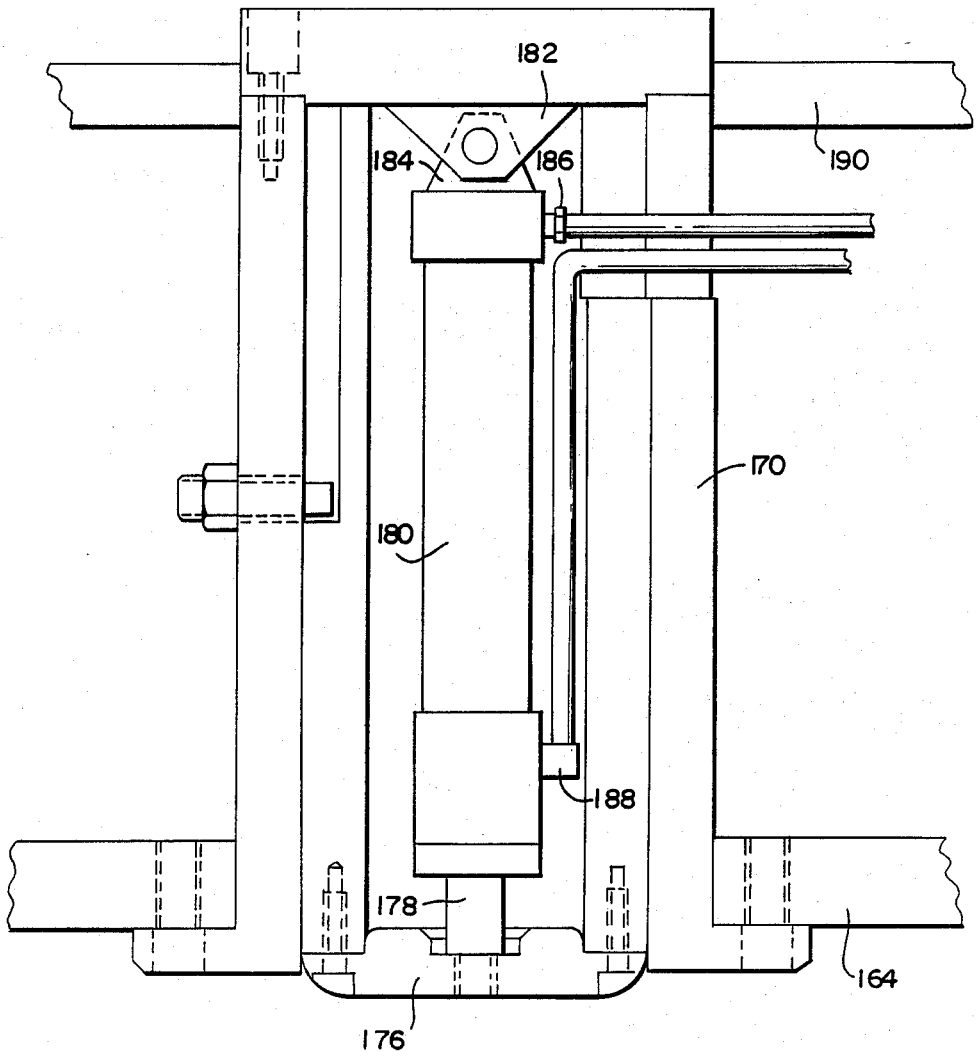
FIG. 8 is a detail, fragmentary side elevational view of the pin assembly.
Figure 9:
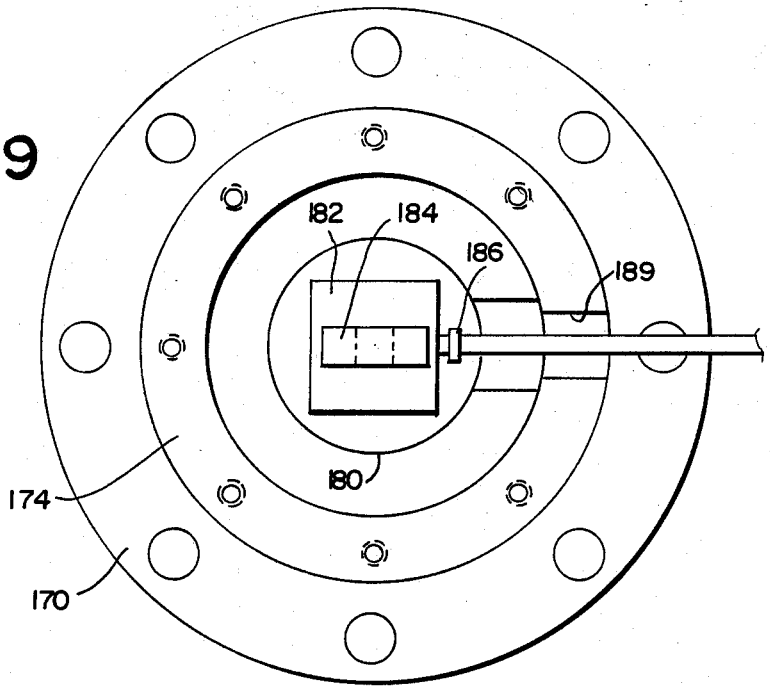
FIG. 9 is a cross-sectional view of the pin assembly of FIG. 8 taken along lines AA.
Figure 10:
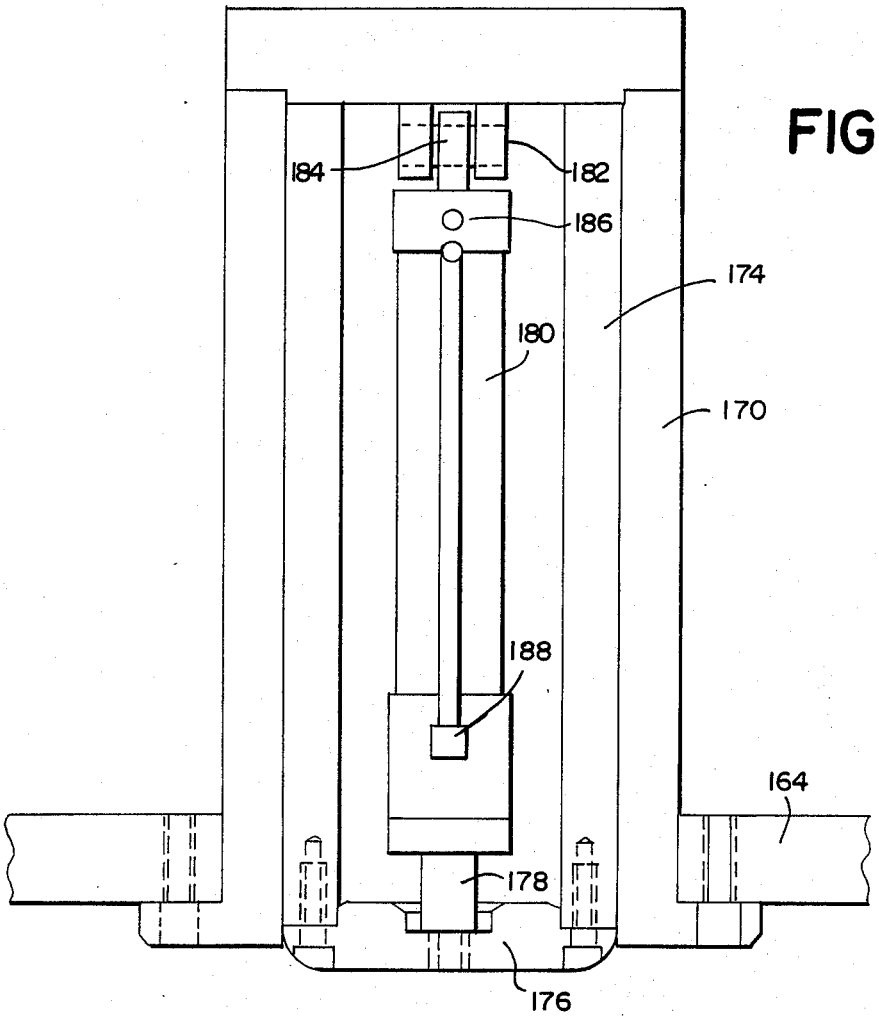
FIG. 10 is a side elevational view of the pin assembly of FIG. 8.

The pin mechanism is shown most clearly in FIGS. 6B, 8 and 10 and includes an external cylinder 170 within which is received the pin 172. Pin 172 comprises an inner tube or cylinder 174 having a lower cup 176 and upper cap 177 affixed at opposite ends. Cap 176 is carried at the end of cylinder rod 178 of cylinder 180. Cylinder 180 is mounted to a clevis bracket 182 by extension 184. Cylinder 180 has fittings 186 and 188 and associated hydraulic supply hoses or tubes which pass through slot 189 for connection to the hydraulic supply system of the vehicle 12.

As shown in FIG. 6B, the upper end of outer cylinder 170 is mounted to an upper plate 190 which is in turn mounted to top bar 191. Stiffeners 192 are added for support. A series of cover or cap plates 193 enclose the pin mechanism and extend upward from the belly plate 146 to the slew ring of the crane 12.

The operation of the pin assembly should be apparent from the previous description. The crane 12 is driven onto the platform perpendicular to its longitudinal axis. Suitable guide markers may be provided to indicate proper alignment of the pin and latch assembly. As the pin approaches the center of the platform, pin 172 bears against the biased plate member 115 and slides there along, forcing plate 115 downward until pin 115 seats in the upper opening of inner sleeve 122. Pin 172 is thereby caused to extend into the opening 128. With pin 172 extending in opening 128, crane 12 is thus prevented from backward or forward motion, but can be counter-rotated about the axis of pin 172 to position the crane along the longitudinal axis of the carrier. When it is desired to off load the crane, cylinder 170 is actuated to retract the pin after the crane is rotated 90 degrees to permit the crane to be driven off the side of the carrier perpendicular to its longitudinal axis.

Although the invention has been described in accordance with the preferred embodiments, it should be understood that various modifications may be made without departing from the true spirit and full scope of the invention as defined by the appended claims.

What is claimed:

1. A rail mounted vehicle carrier comprising a frame assembly having a platform adapted to receive a vehicle to be carried on the carrier, a wheel assembly supported at each end of the carrier, a latch assembly disposed on said frame assembly and adapted to receive a retractable pin mounted on the underside of the vehicle, means on said vehicle for operatively positioning said pin between a first position engaging said latch assembly and a second position disengaging said latch assembly whereby when said pin is positioned in said first position said vehicle is fixed with respect to the axis of the pin and forward or backward movement of said vehicle on the platform is prevented while counter-rotation of the vehicle on the platform about the pin axis is permitted.

2. A rail mounted vehicle carrier as set forth in claim 1, including means for pivotally supporting each said wheel assembly to said frame assembly.

3. A rail mounted vehicle carrier as set forth in claim 2 wherein said means for pivotally supporting each said wheel assembly includes latch means on each said wheel assembly for latching the associated assembly in a fixed position to support the carrier on the rails.

4. A rail mounted vehicle as set forth in claim 3 further including jack means on said platform disposed to permit jacking directly upon the head of the rails to lift the vehicle and permit unlatching of the wheel assemblies and support of the vehicle on the ground.

5. A rail mounted vehicle as set forth in claim 4 wherein said frame assembly includes a longitudinally extending frame member at each side of said assembly, at least a pair of cross frame members including channels adjacent opposite ends to permit clearance of the rails by the cross frame members while supporting the cross members on the ground surface.

6. A rail mounted vehicle as set forth in claim 1 further including means for driving said carrier from the vehicle carried thereon.

7. A rail mounted vehicle as set forth in claim 1 wherein said vehicle carried on said platform includes a hydraulic system and means on said vehicle and said platform for coupling each said wheel assembly to said hydraulic system for powering the carrier from the vehicle carried thereon.

8. A method for transporting a crawl track vehicle on a deck of a rail transporter having front and back wheel assemblies pivotally supported between a first and second position, the wheel assemblies being fixed when latched in the first position or the second position, comprising positioning the transporter at a first location on a set of rails for loading a crawl track vehicle having driving tracks, driving the crawl track vehicle onto the transporter with the driving tracks in engagement with the deck of the transporter and substantially perpendicular to the longitudinal axis of the transporter, latching the vehicle to the transporter about a fixed axis to prevent forward and backward movement thereof, and counter-rotating the crawl track vehicle about the fixed axis while the tracks remain in engagement with the deck of the transporter to position the tracks parallel to the longitudinal axis of the transporter latching the wheel assemblies in the fixed first position to support the carrier on the rails and pivoting said wheel assemblies in the fixed second position above the deck of the transporter.

9. The method as set forth in claim 8 further including transporting the transporter to a second location with the crawl track vehicle latched thereon and positioned with its track parallel to the longitudinal axis of the transporter.

10. The method as set forth in claim 8 further including jacking the transporter directly upon the head of the rails, to lift the transporter above the rails; unlatching the wheel assemblies from the fixed second position, pivoting the wheel assemblies to the first position for engagement with the rails, latching the wheel assemblies in the first position and disengaging the jacking to support the transporter on the rails.

11. The method as set forth in claim 8 further including powering said transporter on the rails from the vehicle carried thereon.

12. The method as set forth in claim 8 including hydraulically coupling said wheel assemblies to a hydraulic system of the vehicle to be transported for powering the transporter from the vehicle carried thereon.

13. The method of claim 8 further including supporting the transporter directly on the ground between the rails.

* * * * *